US005575469A

United States Patent [19]

Coombs et al.

[11] Patent Number: 5,575,469

[45] Date of Patent: Nov. 19, 1996

[54] SHEET RECEIVER WITH INFEED SPEED VARIED BY MEASURED LENGTH OF SHEET

[75] Inventors: Peter M. Coombs, Tustin; Edward Seibel, Fountain Valley; Bryson Bennet, Westminster, all of Calif.

[73] Assignee: Gradco (Japan) Ltd, Tokyo, Japan

[21] Appl. No.: 378,218

[22] Filed: Jan. 25, 1995

[51] Int. Cl.[6] ..... B65H 5/34

[52] U.S. Cl. ..... 271/270; 271/202; 271/176; 271/292

[58] Field of Search ..... 271/176, 202, 271/270, 292, 293, 294

[56] References Cited

U.S. PATENT DOCUMENTS

| | | | |
|---|---|---|---|
| 4,634,263 | 1/1987 | Miwa | 271/270 |
| 4,676,499 | 6/1987 | Kimizuka et al. | 271/270 |
| 4,974,828 | 12/1990 | Matsuo et al. | 271/293 |
| 5,090,673 | 2/1992 | Kitahara et al. | 271/270 |
| 5,104,110 | 4/1992 | Haibara | 271/270 |
| 5,253,860 | 10/1993 | Hirose et al. | 271/294 |
| 5,395,102 | 3/1995 | Eguchi | 271/270 |
| 5,423,527 | 6/1995 | Tranquilla | 271/270 |
| 5,482,265 | 1/1996 | Nakazato et al. | 271/270 |

*Primary Examiner*—Karen B. Merritt
*Assistant Examiner*—Douglas Hess
*Attorney, Agent, or Firm*—Newton H. Lee, Jr.

[57] ABSTRACT

A sheet receiver has multiple trays for receiving printed sheets from a host copier or printer to collate or receive the printed sets or jobs made up of sequential sheets fed to the trays by an infeed roll driven at variable speeds depending upon the measured length of the sheets as they are moved past a sheet sensor by the infeed roll.

4 Claims, 3 Drawing Sheets

SHEET RECEIVER WITH INFEED SPEED VARIED BY MEASURED LENGTH OF SHEET

BACKGROUND OF THE INVENTION

In the feeding of paper sheets into the trays of sorting machines or sheet receivers of the kinds used with office copiers, printers or the like, placement of the sheets in a neat stack or set within the trays depends upon appropriate control of the infeed speed of the sheets, whether the trays are more or less horizontal and the size of the sheets of paper.

Sorting machines for use with copiers or receivers useful as mailboxes with printers may have moving trays or fixed trays, as exemplified in many prior patents, including U.S. Pat. No. 5,253,860 issued Oct. 19, 1993 to Hirose, et al, U.S. Pat. No. 5,186,454 issued Feb. 16, 1993 to Kitahara, and U.S. Pat. No. 4,974,828 issued Dec. 4, 1990 to Matsuo, et al., all of which are examples of moving bin sorters, and U.S. Ser. No. 332,181, filed Oct. 31, 1994 and U.S. Pat. No. 5,346,205 issued Sep. 13, 1994.

Each of the prior U.S. patents referred to above are of the moving bin type, have some type of means for modifying the sheet infeed speed of sheets entering the trays to assist in the proper placement of successive sheets in sets in the trays.

U.S. Pat. No. 5,253,860 utilizes an interface with the host machine to provide paper size information from the host to vary the paper feed motor speed depending upon paper size.

U.S. Pat. No. 5,186,454 utilizes a signal indicator of upward or downward movement of the trays of a moving tray sorter to vary the speed of the sheet infeed motor depending upon the direction in which the trays are being moved.

U.S. Pat. No. 4,974,828 utilizes a sheet trailing edge detector to vary the speed of a sheet infeed motor so that the motor drives the sheet initially at one speed to prevent any bending of the sheet between the sorter infeed roll and the host output roll, then a second speed corresponding to the output feed speed, and finally, a third speed faster than the output speed to finally feed the sheets into the trays.

However, in a fixed bin sorter mailbox as disclosed in U.S. Ser. No. 332,181 or in U.S. Pat. No. 5,346,205 where the trays are not moved, nevertheless, sheet infeed into fixed bins is secured by a trailing edge detector which controls sorting operations.

In any case, an object of all of the above referenced prior art is to assemble sets of sheets in the trays in a neat stack or set and the sheet speed or flight into the tray is a factor. In the case of most sorters the sheet is caused to be moved in the infeed direction, along an incline and then settle or slip back against a rear wall of the tray for registration of an edge of the set sheets. Thus, the flight path and speed of sheet movement over the rear wall of the tray are factors which impact the sheet set formation which are addressed by the prior art, as described above.

SUMMARY OF THE INVENTION

The present invention employs a system of measuring the length of paper sheets passing from the exit roll of a host copier or printer and moving into the infeed nip or roll of a sheet sorter or mailbox or other receiver, independently of the host machine or any paper feed speed information derived therefrom.

More particularly, the measurement is made of the elapsed time for the movement of a sheet traveling from the output roll of the host unit at a known velocity to provide a signal to the input nip or roll of the receiver to determine the speed of such nip or roll so as to control the speed at which sheets of different sizes are deposited in the receiver tray as they are caused to move across the usual rear registration wall of the tray and up the inclined surface of the tray or sheets in the tray so as to assist in the formation of sets of sheets uniformly registered against the rear wall of the tray independently of the size of the sheet.

In accordance with this concept, measurement of the length of the various sizes of sheets in the sheet feed direction is employed to control the nip or infeed roll speed so that longer sheets are fed at a greater velocity than shorter sheets.

In accordance with the invention the measurement of the sheet is performed and the sheet driving motor control without requiring interface with the host machine and utilizing the usual sheet presence detector included in the typical sheet receiver which senses the entry of the leading edge of a sheet and the passage of the trailing edge of the sheet which enables counting the period of time during which the switch is activated by the sheet and uses the time to vary the feed motor speed.

In practice the setting of the motor speed as a function of sheet measurement will cause the input roll drive motor to rotate at the same speed until such time as the time counter encounters a sheet of a different size so as to reset the infeed motor speed.

Other features and advantages of the invention will be hereinafter described or will become apparent to those skilled in the art in the light of the following specification and the drawings annexed hereto and made part hereof.

DESCRIPTION OF THE PREFERRED EMBODIMENT

Figure 1:
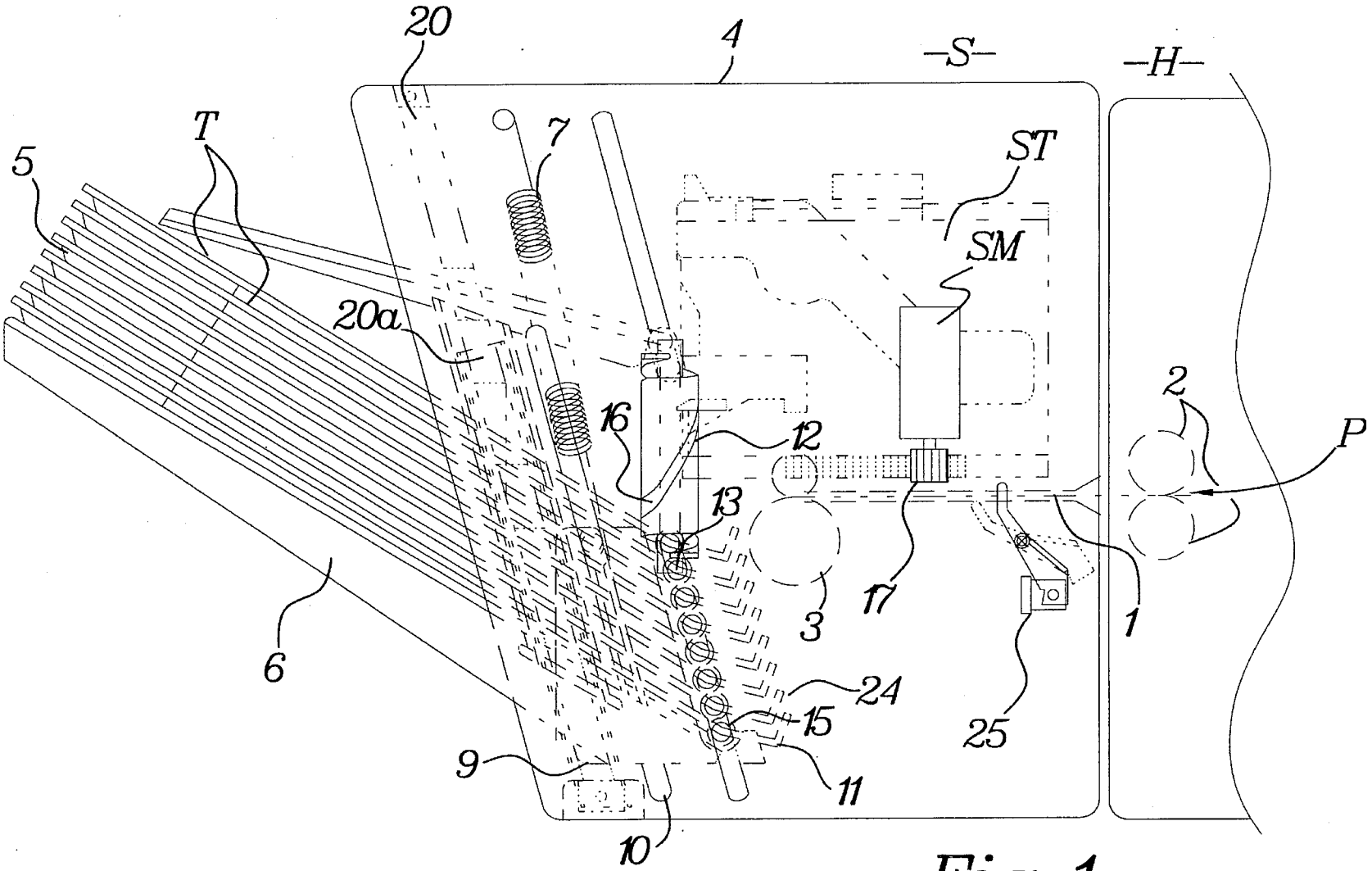
FIG. 1 is a side elevation showing an in-bin stapling sorter incorporating the invention.

As seen in the drawings, referring first to FIG. 1, a sorting machine S constitutes a paper output device positioned adjacent to a host copying or printing machine H which constitutes a paper supplying device. Sheets of paper are fed through a feed path 1 from outlet feed rolls 2 of the host to infeed rolls 3 of the sorter or output device. Such a sorter is more particularly disclosed in the application of Coombs, Ser. No. 334,907 filed Nov. 7, 1994, and co-owned herewith to which reference may be made.

A set of trays T are extended horizontally, but at an incline from the sorter housing 4 and pivotally and slidably rest one on the other at their outer ends 5, except that the outer end of the lower most tray T rests on a bottom tray support 6. Tray support 6 is adapted to move vertically and is biased upwardly at its inner end by a coiled spring 7 connected at its upper end to the housing and at its lower end to a lift frame 9 adapted to move vertically in a guide slot 10, as the inner ends 11 of the trays are caused to move vertically.

Figure 2:
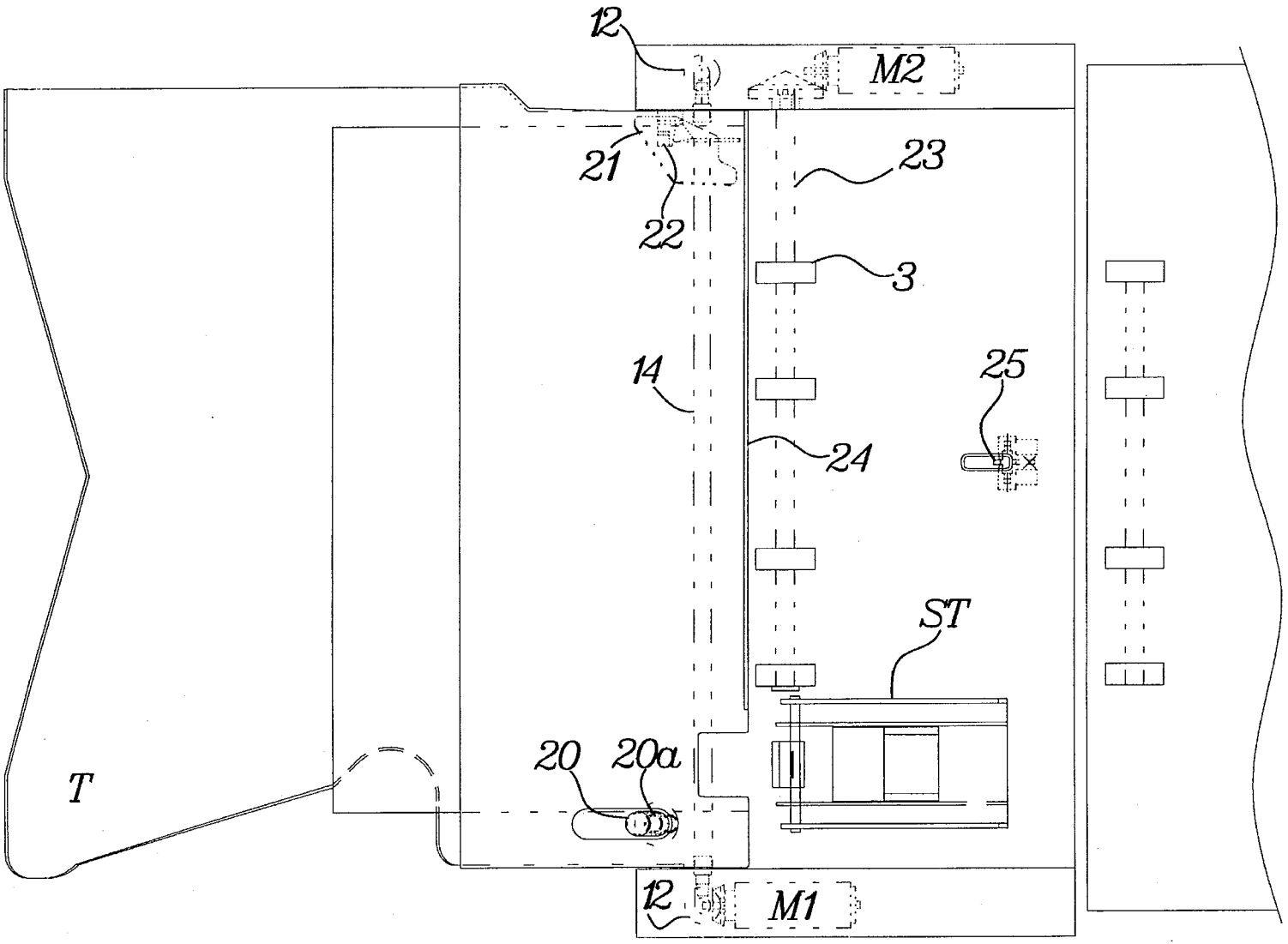
FIG. 2 is a top plan view with the cover removed to show the infeed drive motor and paper sensor.

Vertical movements of the inner tray ends 11 are caused in response to rotation of a pair of spiral cams 12 at opposite sides of the tray and rotatable with shafts 13 adapted to be driven in unison by a reversible drive motor M1 and a transversely extended drive shaft 14 (FIG. 2). Each tray end 11 has a pair of trunnions 15 for engagement in a spiral cam track 16 for opposite movement of the tray ends 11 responsive to opposite rotation of cams 12.

In the form shown, a stapler ST is provided in the housing and is adapted to be shifted by a motor SM and gearing 17 between the retracted non-stapling position of FIG. 2 and a stapling position.

The structure as thus far described, is well known to those skilled in the art and needs no further detailed description. However, in such sorters having a finisher or stapler receiving the sets of sheets supplied in the host copier or printer in neat sets is important.

Means are provided for jogging or aligning sheets of paper between a vertically extended alignment member 20 having a first alignment surface 20*a* at one side of the trays T in response to vertical movement of the trays. The trays are inclined from the horizontal, and member 20 extends substantially normal to the trays Various jogging or aligning means may be employed, such as in the above mentioned prior patent.

As shown, however, the jogging or aligning means is like that disclosed in the Coombs and Seay U.S. Pat. No. 5,393,042, granted Feb. 28, 1995. The aligning or jogging means is denoted at 21 and is in the form of a vertical member 22 located at the opposite side of the trays from the alignment member 20 and automatically jogs the sheets towards surface 20*a* as more fully disclosed in the just mentioned patent.

Referring to FIG. 1, it will be seen that the sheets of paper P, indicated by the arrow are fed from the output rolls of the host machine through the feed path 1 and to the feed rolls 3 which cooperate with a nip roll to provide the sheet feeding means in the output unit S. The feed rolls 3 are driven, as seen in FIG. 2, by motor means M2 and a shaft 23 driven by the motor M2 so that sheets are successively fed into the enlarged space defined between trays by the cams 12.

As the sheets are being fed into the respective trays in the normal operation of the sorter, the sheets will be caused to be projected or fly over a rear wall 24 at the rear end of each tray which commonly is referred to as a backstop, and upon operation of the jogging means described above, the sheets will be aligned at their opposite side edges. Alignment of the trailing edge of the sheets against the backstop 24 to provide comparatively neat sets of sheets into which staples may be driven by the stapler, depends upon whether the sheets can settle rearwardly against the backstop 24.

However, depending upon the size of the sheet being fed by the feed roll 3 into the trays, if the feed roll speed is constant, say at the same speed as the output rolls 2 of the host machine, then every size of sheet supplied to the trays will be moved at the same rate of speed. This results in short sheets being fed at the same rate as long sheets and therefore short sheets being caused to fly over the backstop wall 24 and up the incline of the tray such that depending upon the paper characteristics and static and the like, the short sheets may not descend rearwardly to the backstop 24, while on the other hand, if the longer sheets are fed at the same speed as the short sheets, the longer sheets may not be caused to feed entirely into the tray past the backstop 24.

Thus, in accordance with the invention, the feed rollers 3 are caused to rotate at a speed which varies in accordance with the length, in a sheet feeding direction so that short sheets are fed at a speed slower than the long sheets. This is accomplished by measurement of the length of the sheet in the sheet feeding direction by means including a paper sensing switch 25 disposed in the feed path 1 and adapted to detect first, the leading edge of a sheet as it moves through the feed path and, then, the trailing edge of the sheet.

Figure 3:
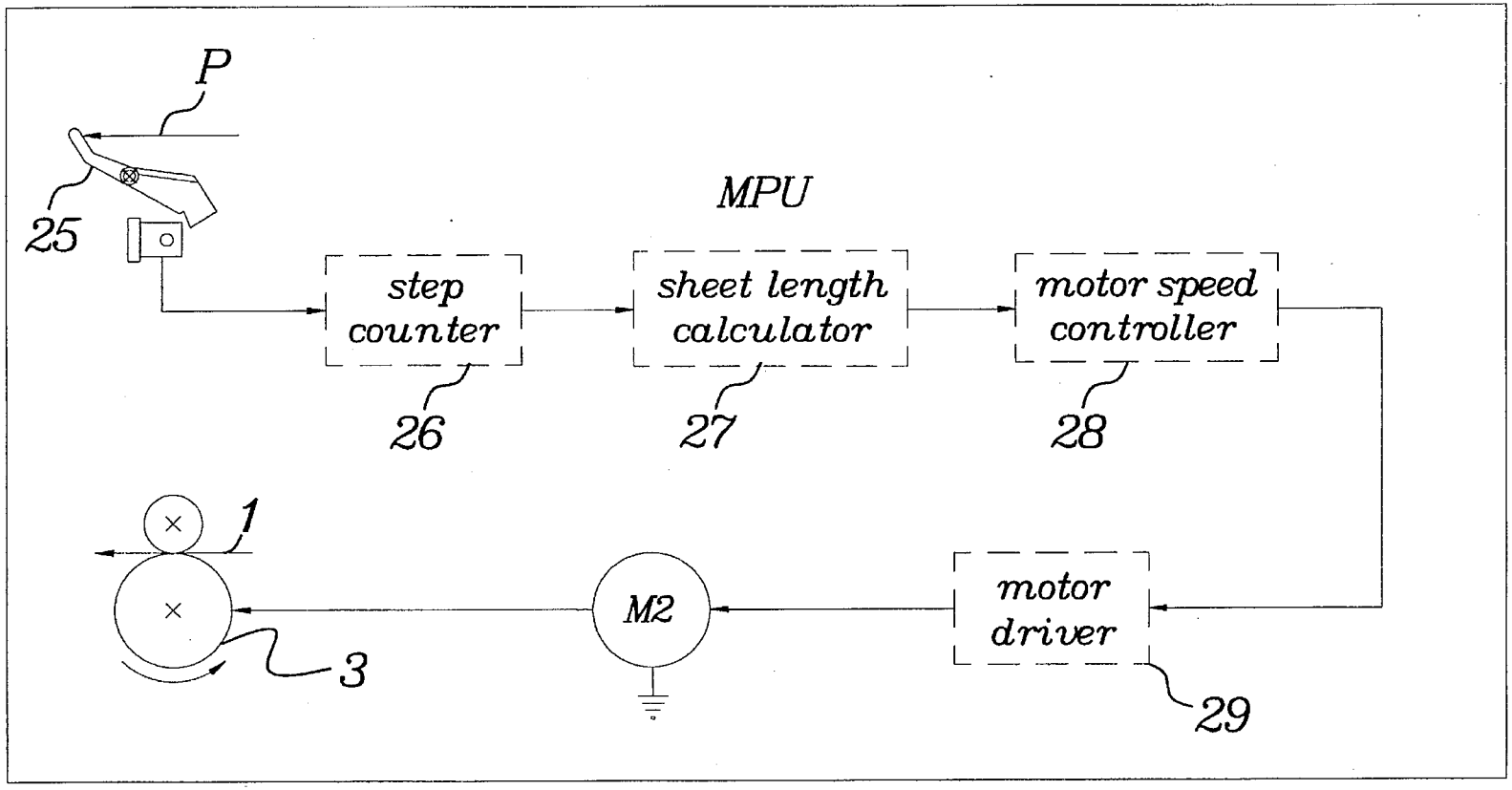
FIG. 3 is a diagrammatic view of the sheet measuring and feed motor speed control means.

As seen in FIG. 3, the sheet detector switch 25 is adapted to coact with the usual micro processor unit MPU which is provided with a step counter 26 by which the length of a sheet of paper passing the detector switch 25 is measured or calculated as to the length, in a sheet feed direction, by a sheet length calculator incorporated in the MPU. The sheet length calculator 27 is in turn adapted to function together with a motor speed controller 28 to cause a motor driver 29 to supply power to the motor M2 causing it to drive the feed roll 3 at a speed determined by the measured length of the first sheet of a group of sheets being supplied to the sorter and to maintain the motor speed rate so long as each successive sheet is of the same length.

When a sheet of a different length, either longer or shorter, is supplied through the feed path and into contact with the sheet lead edge and trail edge detector 25, the step counter 26 and sheet length calculator 27 in the MPU will cause the motor speed controller 28 to establish a correspondingly different drive speed for the motor M2.

Accordingly, as the sheets are supplied to the respective trays of the output device, the sheets are all caused to move into the tray at the appropriate speed so that the sheets are caused to fly over and then settle back upon the backstop 24 as previously described.

Since the number of sheets entering each tray is known, the motor speed may also be adjusted to compensate for the number of sheets in a set as the sheets progressively change the effective height of backstop 24.

We claim:

1. A sheet output device operatively connectable to a host copier or printer machine, the host copier or printer machine providing successive sheets to the output device for deposit in a plurality of horizontally extended trays disposed one above the other, said output device having feed roller means for feeding the sheets received from the host machine to the horizontally extended trays, said trays extending upwardly at an incline from a sheet infeed end thereof to which sheets are supplied from said feed roller means and having a backstop at said sheet infeed end, a drive motor for rotationally driving the feed roller means at a rotational speed depending upon the rotational speed of said drive motor, and a control means for controlling the rotational speed of said drive motor, the improvement wherein said output device includes sheet length detector means for detecting the leading edge and the trailing edge of a sheet received by said feed roller means, and means responsive to said sheet length detector means and acting on said control means to vary the speed of said drive motor depending upon the detected length of successive sheets to vary the speed of travel of a sheet over said backstop.

2. A sheet output device as defined in claim 1, wherein said control means includes a sheet length calculator.

3. A sheet output device as defined in claim 1, wherein said control means includes a sheet length calculator, and a step counter responsive to engagement of said sheet length detector with a sheet and associated with said sheet length calculator.

4. A sheet output device as defined in claim 1, wherein said sheet output device includes means for moving said trays vertically to a sheet infeed location adjacent to said feed roller means.

* * * * *